US006499394B1

(12) United States Patent
Kawagoe et al.

(10) Patent No.: US 6,499,394 B1
(45) Date of Patent: Dec. 31, 2002

(54) STENCIL PRINTER

(75) Inventors: Katsumi Kawagoe, Amimachi (JP); Muneaki Kawai, Amimachi (JP); Shigeki Fukai, Amimachi (JP); Hitoshi Watanabe, Amimachi (JP); Kinya Ono, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/612,097

(22) Filed: Jul. 7, 2000

(30) Foreign Application Priority Data

Jul. 9, 1999 (JP) ..... 11-195486

(51) Int. Cl.[7] ..... B05C 17/06

(52) U.S. Cl. ..... 101/128.1; 101/128.4; 101/DIG. 42

(58) Field of Search ..... 101/114, 116, 101/128.1, 128.21, 128.4, DIG. 42

(56) References Cited

U.S. PATENT DOCUMENTS 4,628,813 A * 12/1986 Hasegawa et al. ..... 101/116
5,438,347 A * 8/1995 Shishido et al. ..... 101/114
5,953,985 A * 9/1999 Kobayashi ..... 101/116
5,988,061 A * 11/1999 Kagawa ..... 101/128.4
6,220,155 B1 * 4/2001 Kimura ..... 101/128.4

FOREIGN PATENT DOCUMENTS

EP 0 888 897 A1 1/1999
JP 2538817 7/1996

* cited by examiner

*Primary Examiner*—Ren Yan
(74) *Attorney, Agent, or Firm*—Nixon Peabody LLP; Donald R. Studebaker

(57) ABSTRACT

In a stencil printer, an elastic member is provided on a master conveying path from a roll of master sheet to a master pinch drum. The elastic member is pressed against the master sheet to apply back tension to the master sheet when the master sheet is moved by rotation of the master pinch drum after the leading end of the master sheet has been clamped to the clamp portion of the master pinch drum.

5 Claims, 6 Drawing Sheets

STENCIL PRINTER

BACKGROUND OF THE INVENTION

1. Field of the Invention

The present invention relates to a stencil printer equipped with a master making section, and more particularly to structure for applying back tension in wrapping a perforated stencil paper (hereinafter referred to as a perforated master sheet) around a master pinch drum.

2. Description of the Related-Art

A conventional stencil printer equipped with a master making section is shown, for example, in Japanese Patent Publication No. 2538817. Master conveying rollers and master discharging rollers are provided behind the master making section to warp a perforated master sheet around a master pinch drum after the perforated master sheet has been made. When making the perforated master sheet, the master discharging rollers are stopped and the master conveying rollers are rotated to slacken the perforated master sheet between the discharging and conveying rollers and store the slack part therebetween. At the time the master making process has ended, the master pinch drum with the leading end of the master sheet clamped to the clamp portion of the drum is rotated to wrap the master sheet around the drum, while tension is being applied to the master sheet by the discharging rollers.

In the process of wrapping the master sheet around the drum, it is important from the standpoint of obtaining an accurate master-wrapped state to apply stable back tension to the master sheet when the master sheet, the leading end of which is clamped to the clamp portion of the drum, is wrapped around the drum by rotation of the drum. However, in the aforementioned stencil printer, there is a danger that stable back tension cannot be applied to the master sheet, because back tension is applied only by rotation of the discharging rollers resulting from movement of the master sheet.

That is, when the perforated master sheet is wrapped around the master pinch drum, the master sheet has been slackened and stored on an upstream side from the discharging rollers. In this state, in the case where back tension is applied to the master sheet only by the rolling resistance which occurs due to rotation of discharging rollers caused by movement of the master sheet, a certain degree of back tension can be applied at the moment the master sheet starts moving from the stopped state thereof to rotate the master discharging rollers. However, after the discharge rollers have started rotating, it is mechanically difficult to apply stable back tension to the master sheet because of load fluctuation in the rotation of the discharging rollers.

SUMMARY OF THE INVENTION

The present invention has been made in view of the aforementioned problems found in the aforementioned stencil printer. Accordingly, the primary object of the present invention is to provide a stencil printer which is capable of performing an accurate master wrapping operation by applying stable back tension when a master sheet with the leading end clamped to a master pinch drum is wrapped around the drum.

To achieve this end and in accordance with one important aspect of the present invention, there is provided a stencil printer wherein an elastic member is provided on a master conveying path from a roll of unperforated master sheet to a master pinch drum, the elastic member being pressed against a perforated master sheet to apply back tension to the perforated master sheet when the perforated master sheet is moved by rotation of the master pinch drum after the leading end of the perforated master sheet has been clamped to the clamp portion of the master pinch drum.

In accordance with another important aspect of the present invention, there is provided a stencil printer wherein along a master conveying path from a roll of unperforated master sheet to a master pinch drum, a master making section, master conveying rollers, and master discharging rollers are disposed in order so that a perforated master sheet is slackened between the master conveying rollers and the master discharging rollers; and an elastic member is provided between the master discharging rollers and the master pinch drum, the elastic member being pressed against the perforated master sheet to apply back tension to the perforated master sheet when the perforated master sheet is moved by rotation of the master pinch drum after the leading end of the perforated master sheet has been clamped to the clamp portion of the master pinch drum.

In accordance with still another important aspect of the present invention, there is provided a stencil printer wherein along a master conveying path from a roll of unperforated master sheet to a master pinch drum, a master making section, master conveying rollers, and master discharging rollers are disposed in order so that a perforated master sheet is slackened between the master conveying rollers and the master discharging rollers; and an elastic member and a smoothing member are provided between the master discharging rollers and the master pinch drum, the smoothing member being fixed with the stencil printer, the elastic member being pressed against the smoothing member through the perforated master sheet to apply back tension to the perforated master sheet when the perforated master sheet is moved by rotation of the master pinch drum after the leading end of the perforated master sheet has been clamped to the clamp portion of the master pinch drum.

In a preferred form of the present invention, the master discharging rollers apply no load to the perforated master sheet being moved, when the elastic member is in pressing contact with the perforated master sheet.

In another preferred form of the present invention, a mechanism for adjusting a force that the elastic member is pressed against the smoothing member through the perforated master sheet is provided.

According to the present invention, an elastic member is provided on a master conveying path from a roll of master sheet to a master pinch drum and is pressed against the master sheet being moved by rotation of the master pinch drum so that back tension is applied to the master sheet. With this arrangement, a constant and stable back tension can be applied to the master sheet being moved, by the sliding resistance which occurs when the elastic member is pressed against the master sheet. As a result, master-wrapping precision is enhanced, whereby printing quality can be enhanced.

The aforementioned tension blade is disposed between the discharging rollers, which slackens and stores the perforated master sheet, and the master pinch drum. With this arrangement, stable back tension can be applied even at the final stage of wrapping the master sheet around the drum and therefore an accurate master-wrapping operation can be performed. Furthermore, since the master discharging rollers apply no load to the master sheet when the tension blade is in pressing contact with the master sheet, load fluctuation resulting from rotation of the discharging rollers caused by movement of the master sheet can be suppressed and therefore stable back tension can be applied to the master sheet.

BRIEF DESCRIPTION OF THE DRAWINGS

The above and other objects and advantages will become apparent from the following detailed description when read in conjunction with the accompanying drawings wherein.

DESCRIPTION OF THE PREFERRED EMBODIMENTS

Figure 1:
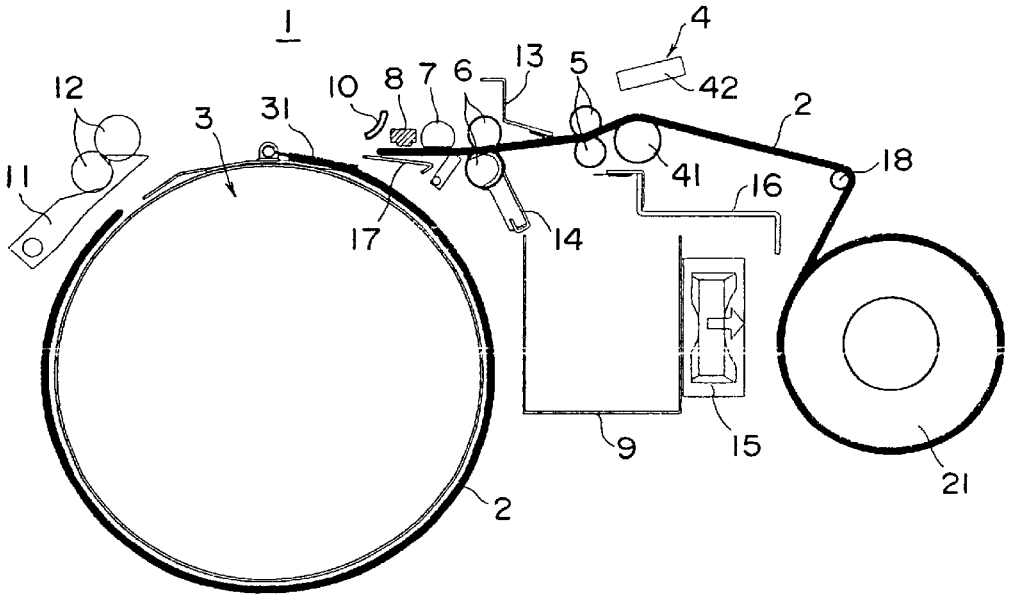
FIG. 1 is a side view showing a stencil printer constructed in accordance a first embodiment of the present invention.

Referring now in greater detail to the drawings and initially to FIG. 1, there is shown a preferred embodiment of a stencil printer in accordance with the present invention. The stencil printer 1 is equipped with a master pinch drum 3 around which a perforated master sheet 2 is wrapped. Although not shown, an ink roller is disposed inside the master pinch drum 3 and abuts the inner peripheral surface of the master pinch drum 3, and a press roller is disposed outside the master pinch drum 3 and pressed against the ink roller through printing paper. Ink, supplied from an ink container to the ink roller, is applied to the printing paper through the perforations of the perforated master sheet 2, whereby stencil printing is performed. For a paper feeding section for feeding printing paper to the printer 1 and a paper discharging section for discharging the paper printed between the master pinch drum 3 and the press roller, the illustrations are also omitted.

A clamp plate 31 for clamping an end of the master sheet 2 is disposed on a portion of the outer peripheral surface of the master pinch drum 3 so that it is rotatable upward from the outer peripheral surface. A claw member 11 for removing the perforated master sheet 2 from the master pinch drum 3 is installed outside the master pinch drum 3. Also, a pair of master discharging rollers 12 for feeding the perforated master sheet 2 to a master discharging section (not shown) is installed outside the master pinch drum 3.

On the other hand, a master making section 4 is installed at the opposite position across the master pinch drum 3 from the master discharging rollers 12. Also, at an upstream position from the master making section 4, a master roll 21 having an unperforated long master sheet 2 in rolled form is rotatably supported by a master holder (not shown). The master sheet 2 paid out from the master roll 21 is perforated at the master making section 4 and cut in a predetermined length. Then, the cut master sheet 2 is wrapped around the outer periphery of the master pinch drum 3.

Along a master conveying path from the master roll 21 to the master drum 3, the master making section 4 includes a platen roller 41, maser conveying rollers (roller pair) 5, master discharging rollers (roller pair) 6, a cutter 7, a stand-by sensor 8, and a tension blade 10, which are disposed in the recited order. The tension blade 10 is constructed of rubber, etc., having a wear-resistant surface.

The master making section 4 further includes a thermal head 42, which is disposed so that it is movable toward and away from the platen roller 41 (i.e., movable up and down with respect to the platen roller 41). At a lowered position where the thermal head 42 is pressed against the platen roller 41, the thermal head 42 performs a master making process on the master sheet 2 interposed between it and the platen roller 41 (perforation by heating). The perforated master sheet 2 is conveyed toward the master pinch drum 3 in proportion to a master making speed.

The upper and lower conveying rollers 5 disposed in close proximity to the platen roller 41 is driven in interlock with the platen roller 41 so that they can convey the master sheet 2 at the same speed as the platen roller 41. The upper and lower discharging rollers 6, disposed on the side of the master pinch drum 3 away from the conveying rollers 5, are able to make positive and reverse rotations by themselves. The conveying rollers 5 and the discharging rollers 6 are each provided in pairs, the lower rollers being drive rollers and the upper rollers being rested on the lower rollers by their dead weight. Each of the upper rollers of the conveying rollers 5 and discharging rollers 6 is provided with a mechanism (not shown) so that it is movable up and down.

The conveying rollers 5 and the discharging rollers 6 are provided so that the respective upper rollers move upward during movement of the master sheet 2 caused by rotation of the master pinch drum 3. Thus, the conveying rollers 5 and the discharging rollers 6 apply no load to the master sheet 2 being moved by rotation of the master pinch drum 3.

Between the conveying rollers 5 and the discharging rollers 6, a master storing box 9 constituting a container opened at its upper end is disposed under the master sheet 2. Also, a press plate 13 having an electricity removing brush at its lower end is disposed above the master sheet 2. A guide plate 14 is disposed under the lower roller of the discharging rollers 6 and directed toward the master storing box 9. The master storing box 9 is provided with a suction fan 15. A cover 16 is provided between the fan 15 and the master making section 4. In performing the initial setting of the master sheet 2, the guide plate 14 rotates approximately horizontally to cover the opening of the master storing box 9, thereby guiding the master sheet 2 easily to the side of the discharging rollers 6.

The cutter 7 is to cut the master sheet 2 in a direction perpendicular to the conveying direction and is constructed of an upper rotating blade and a lower receiving blade. The stand-by sensor 8 is used for detecting passage of the master sheet 2 and consists of a transmission or reflection type of optical sensors, etc. Under this stand-by sensor 8, a plate member 17 [which is equivalent to a "smoothing" member as set forth in claim 1)] for supporting the lower surface of the master sheet 2 is disposed. This plate member 17 is fixed to a side plate (not shown) of the stencil printer 1, and the upper surface facing the side of the tension blade 10 is a smoothing surface.

The tension blade 10 has a curved surface contactable with the master sheet 2 and is provided with a mechanism (not shown) so that it can move toward and away from the plate member 17. That is, the tension blade 10 can apply back tension to the master sheet 2 by the sliding friction which occurs when the tension blade 10 is pressed against the plate member 17 through the master sheet 2. The tension blade 10 is supported by a blade support member (not shown), and the distance that the tension blade 10 moves toward or away from the plate member 17 is constant. The blade support member (not shown) is provided with a mechanism (not shown) of adjusting an amount that the tension blade 10 projects toward the plate member 17. With this mechanism, the pressure of the blade 10 against the master sheet 2 can be adjusted.

Note that the master sheet 2 paid out from the master roll 21 is fed to the master making section 4 through a guide member 18 which bends the master sheet 2 in the opposite direction from the direction in which the master roll 21 is rolled.

The stencil printer 1 is further provided with a control unit (not shown). In response to detection signals, etc., detected by the stand-by sensor 8 and the other sensors (whose illustration and description are omitted), the control unit performs up-and-down movement control and master making control for the thermal head 42 of the master making section 4, drive control for the platen roller 41 and conveying rollers 5, drive control for the discharging controls 6, up-and-down movement control for the respective upper rollers of the conveying rollers 5 and discharging rollers 6, drive control for the cutter 7, up-and-down movement control for the tension blade 10, rotation control and printing control for the master pinch drum 3, drive control for the clamp plate 31, claw member 11, and discharging rollers 12, and so on. Note that the aforementioned master pinch drum 3 is rotatably supported on the main body of the printer 1. Also, each component other than the drum 3 (i.e., master roll 21, platen roll 41, conveying rollers 5, discharging rollers 6, etc.) is disposed with respect to side plates (not shown) of the main body, or members supported by the side plates, so that it can perform a predetermined operation.

Illustrated in FIG. 1 is a stand-by state waiting for the next master making process. The previous perforated master sheet 2 has been wrapped around the master pinch drum 3, and printing has been performed on printing paper through the perforated master sheet 2. In this state, at the position of the leading end of the unperforated master sheet 2 detected by the stand-by sensor 8, the operation of the rollers 41, 5, 6 is stopped and the rollers wait for start of the master making process. The master making process and the master wrapping process from this stand-by state will hereinafter be described.

Figure 2:
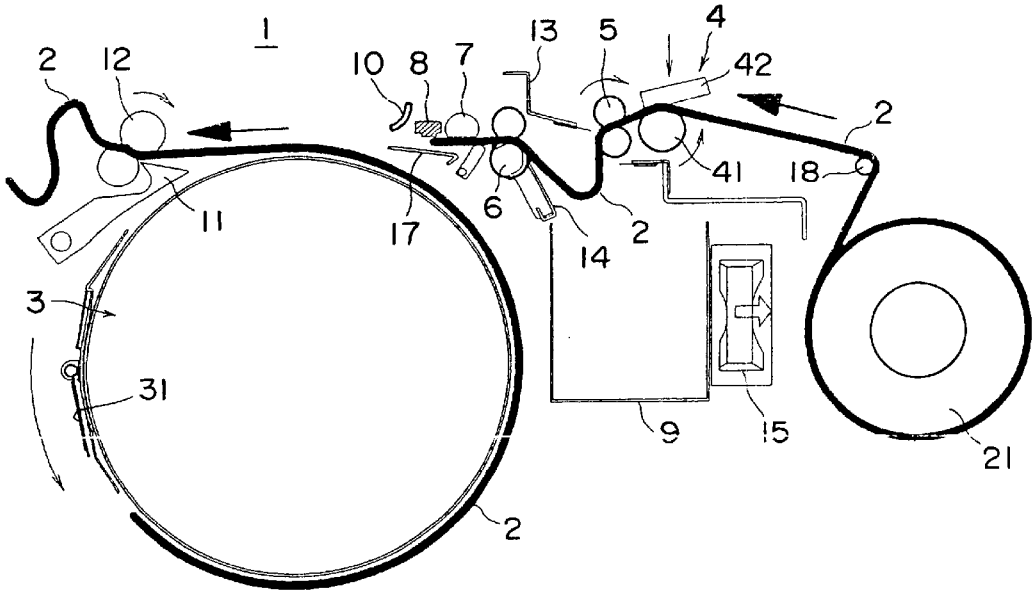
FIG. 2 is a view similar to FIG. 1 showing the state in which master making operation has been started.

At the time of the start of the master making process, the thermal head 42 of the master making section 4 is moved downward and pressed against the platen roller 41 through the master sheet 2, as shown in FIG. 2. If perforation (writing of image data) with respect to the master sheet 2 is started, the platen roller 41 and the conveying rollers 5 make a positive rotation, thereby feeding the master sheet 2 in proportion to the master making speed. On the other hand, the discharging rollers 6 have the master sheet 2 clamped between them. Because of this, between the conveying rollers 5 and the discharging rollers 6, slack occurs on the master sheet 2 in proportion to a difference in speed between the rollers 5 and 6. The slack part extends downward along the guide plate 14 because the press plate 13 is present above the master sheet 2, and the slack part is stored in the master storing box 9. The slack amount increases, as the master making process proceeds (see FIG. 3).

With the aforementioned start of the master making process, the clamp plate 31 of the master pinch drum 3 is rotated through 180 degrees by a drive mechanism (not shown), so that the clamped end of the master sheet 2 is released from the clamp plate 31. Subsequently, the master pinch drum 3 is rotated to separate the leading end of the master sheet 2 from the drum 3 by the use of the claw member 11. The separated master sheet 2 is discharged to the discharging section (not shown) by the master discharging rollers 12. The state in which the master sheet 2 has completely been separated from the drum 3 is shown in FIG. 3.

Figure 3:
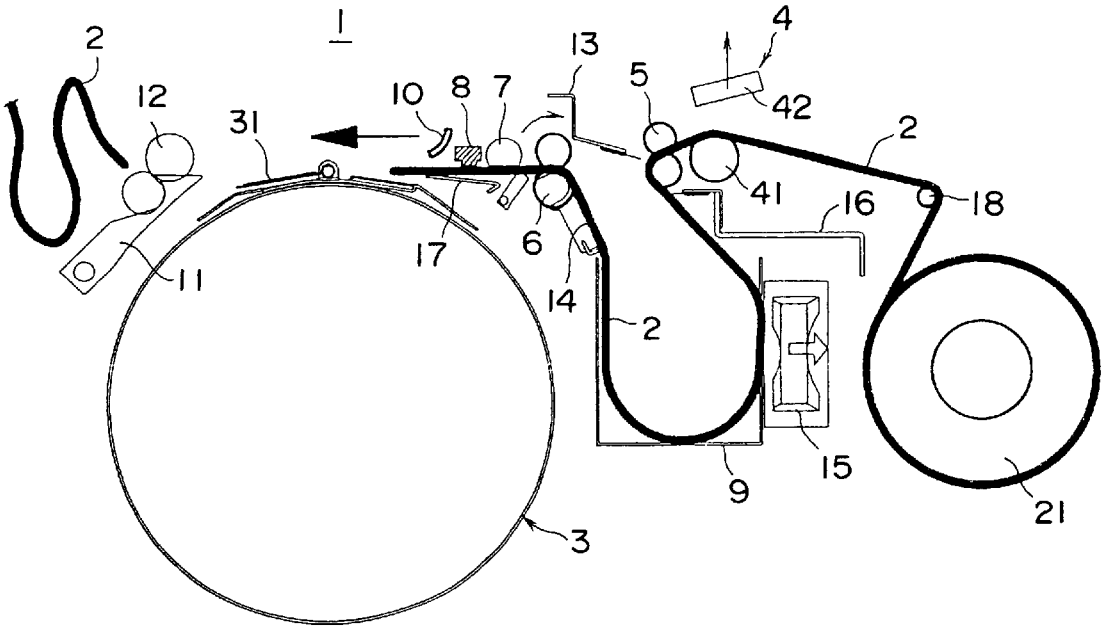
FIG. 3 is a view similar to FIG. 1 showing the state in which the perforated master sheet is fed to the master pinch drum.

As shown in FIG. 3, if the mask making process for a single master sheet ends, the thermal head 42 of the master making section 4 is moved upward, and at the same time, the platen roller 41 and the conveying rollers 5 are stopped. On the other hand, the discharging rollers 6 are driven to make a positive rotation so that the leading end of the master sheet 2 is fed to the clamp portion of the master pinch drum 3. When this occurs, the tension blade 10 is at the raised position and is therefore in non-contact with the master sheet 2.

Figure 4:
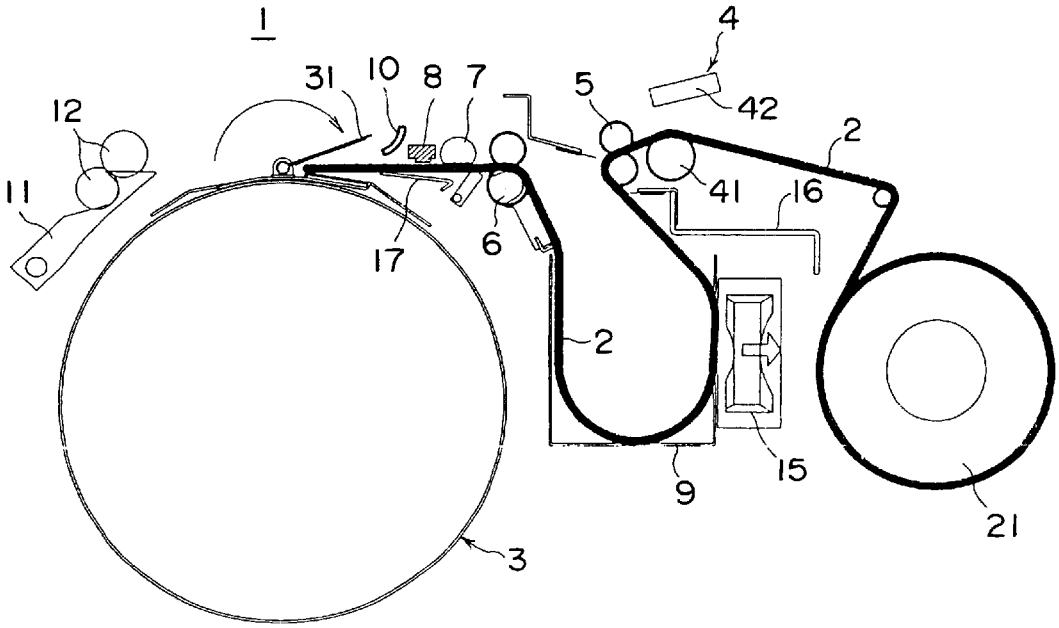
FIG. 4 is a view similar to FIG. 1 showing the state in which the leading end of the perforated master sheet is clamped by the clamp portion of the master pinch drum.

As shown in FIG. 4, if the leading end of the master sheet 2 arrives at a predetermined clamping position by rotation of the discharging rollers 6, the rotation of the rollers 6 is stopped, and at the same time, the clamp plate 31 of the master pinch drum 3 is rotated by the drive mechanism (not shown), whereby the leading end of the master sheet 2 is clamped at the clamp portion of the drum 3.

Figure 5:
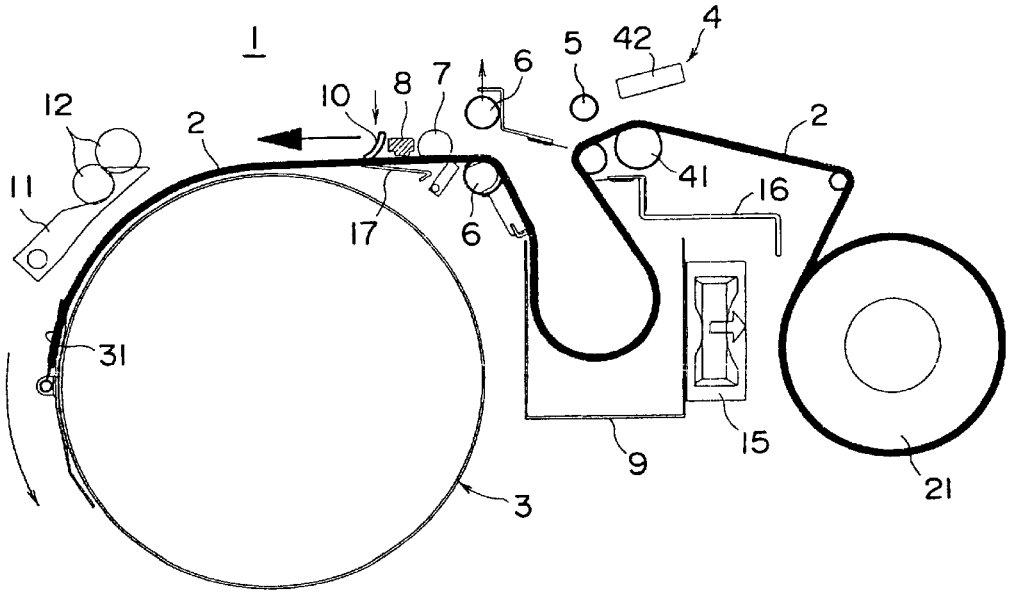
FIG. 5 is a view similar to FIG. 1 showing the initial stage of wrapping the perforated master sheet around the master pinch drum.

Subsequently, as shown in FIG. 5, the respective upper rollers of the conveying rollers 5 and discharging rollers 6 are moved upward, whereby the load exerted on the master sheet 2 by the rollers 5 and 6 is removed. On the other hand, the tension plate 10 is lowered and pressed against the plate member 17 through the master sheet 2 so that a predetermined sliding resistance is exerted on the master sheet 2. At the same time, the master pinch drum 3 is rotated, and consequently, the master sheet 2 is wrapped around the master pinch drum 3, while it is being stretched. When this occurs, back tension is exerted uniformly to the master sheet 2 by the tension plate 10. Note that the respective lower rollers (driving rollers) of the conveying rollers 5 and discharging rollers 6, and the platen roller 41 are at a standstill in a non-driven state.

After the slack part of the master sheet 2 has been absorbed by rotation of the master pinch drum 3, the master roll 21 is rotated by the master pinch drum 3 through the master sheet 2 and therefore the master sheet 2 is paid out from the master roll 21. The pressure of the tension blade 10 against the master sheet 2 is continued.

Figure 7:
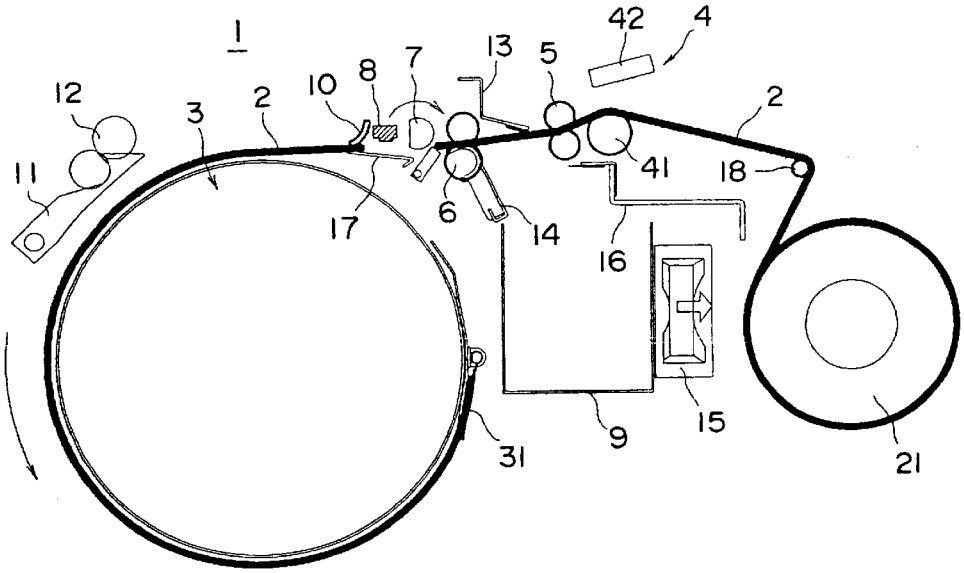
FIG. 7 is a view similar to FIG. 1 showing the state in which the master sheet has been cut in a predetermined length.

Next, the master pinch drum 3 is rotated to a predetermined position so that the master sheet 2 is conveyed by a predetermined length, as shown in FIG. 7. Then, the rotating blade of the cutter 7 is rotated to cut the master sheet 2. Since back tension is exerted on the master sheet 2 by the tension blade 10 near the master pinch drum 3 even after the cutting, the master sheet 2 can be uniformly wrapped around the drum 3 without wrinkles. With the cutting of the master sheet 2, the upper roller of the discharging rollers 6 is lowered so that the master sheet 2 is clamped between the upper and lower rollers 6. Similarly, the upper roller of the conveying rollers 5 is lowered so that the master sheet 2 is clamped between the upper and lower rollers 5.

Figure 8:
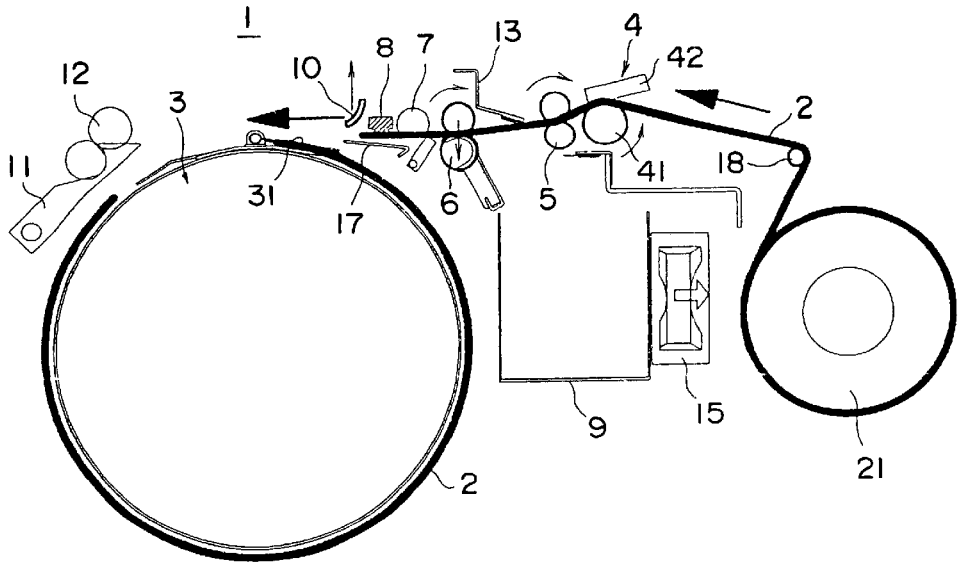
FIG. 8 is a view similar to FIG. 1 showing the final stage of wrapping the perforated master sheet around the master pinch drum.

The master pinch drum 3 is further rotated so that the perforated master sheet 2 with a predetermined length is wrapped around the drum. If the master wrapping process ends, rotation of the master pinch drum 3 is stopped as shown in FIG. 8. The tension blade 10 is raised, while the thermal head 42 of the master making section 4 is lowered. Then, the platen roller 41, the conveying rollers 5, and the discharging rollers 6 are driven to make a positive rotation at uniform velocity, thereby paying out the master sheet 2 from the master roll 21 and feeding it to the master pinch drum 3. If the leading end of the master sheet 2 arrives at the position of the stand-by sensor 8 and if the stand-by sensor 8 performs a detection operation, the platen roller 41, the conveying rollers 5, and the discharging rollers 6 are stopped and the thermal head 42 is raised. As a result, a stand-by state such as that shown in FIG. 1 is obtained.

According to the aforementioned embodiment, the tension blade 10 is in pressing contact with the master sheet 2 when the master sheet 2 is wrapped around the master pinch drum 3, with the leading end of the master sheet 2 clamped at the clamp portion of the master drum 3. Therefore, uniform back tension can be applied to the master sheet 2 and an accurate master wrapping operation can be performed. In addition, since the upper roller of the discharging rollers 6 is raised to remove the load exerted on the master sheet 2, load fluctuation resulting E from rotation of the discharging rollers 6 caused by movement of the master sheet 2 can be suppressed.

While, in the above-mentioned embodiment, the tension blade 10 has been described as an example of an elastic member, the elastic member is not limited to the blade 10. For example, it is also possible to employ a sponge-like elastic member.

Figure 6:
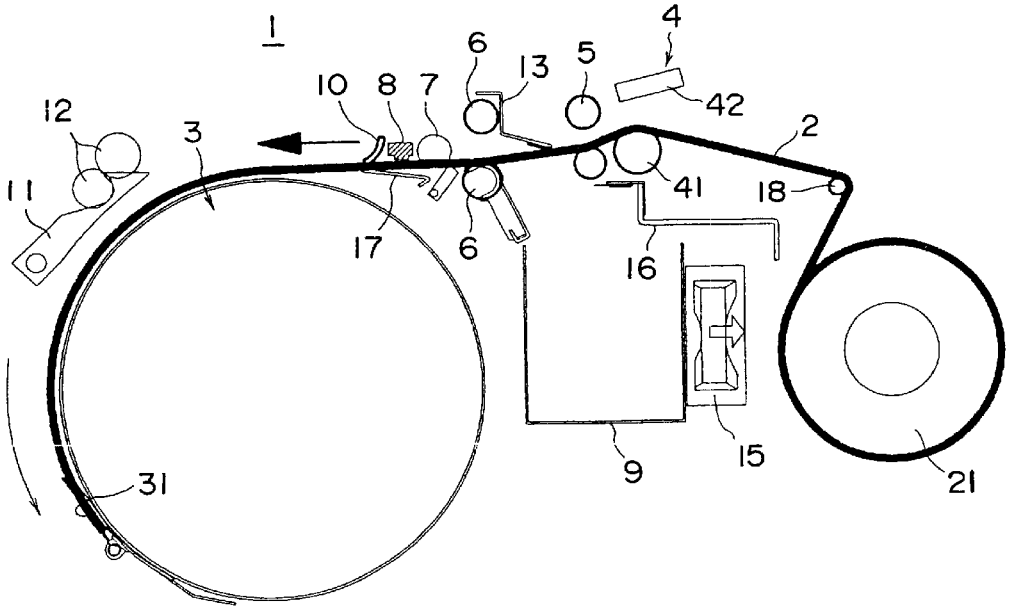
FIG. 6 is a view similar to FIG. 1 showing the state in which the slack part of the perforated master sheet has been absorbed by rotation of the master pinch drum.

While the above-mentioned embodiment has also been described with reference to the stencil printer of the single-operation type in which a slack part of a sheet of master is stored by single operation, the present invention is also applicable to stencil printers of intermittent type in which a sheet of master is wrapped around a master pinch drum while it is being slackened a plurality of times. For instance, in the case where intermittent master making and master wrapping processes are performed by the stencil printer shown in FIG. 1, a master sheet is slackened a plurality of times, and the master sheet perforated is stepwisely wrapped on the master pinch drum, the wrapping process being divided into a plurality of steps. In this case, when the blade 10 is in pressing contact with the master sheet 2, the thermal head 4 and the upper roller of the conveying rollers 5 may be moved upward each time the master making process is performed, as shown in FIG. 6. However, in order to shorten the master making time, it is preferable that the thermal head 42 and the upper roller of the conveying rollers 5 be moved upward only at the last wrapping operation of a plurality of wrapping operations and that, during the wrapping operations other than the last one are performed, the master making operation be performed, without moving the thermal head 42 and the upper roller of the conveying rollers 5 upward.

In the embodiment shown in FIG. 1, the tension blade 10 is interposed between the discharging rollers 6 and the master pinch drum 3, and the distance between the blade 10 and the drum 3 is smaller than the distance between the blade 10 and the roller 6, whereby stable back tension can be applied to the master sheet even at the final stage of wrapping the master sheet around the drum and therefore master-wrapping precision can be further enhanced.

Although, in the above-mentioned embodiment, the roller pair 5 is employed as conveying rollers, the platen roller may double as conveying rollers. In this case the master making section is constructed of the thermal head and does not include the platen roller. This embodiment will herein after be described with reference to FIGS. 9 and 10.

Figure 9:
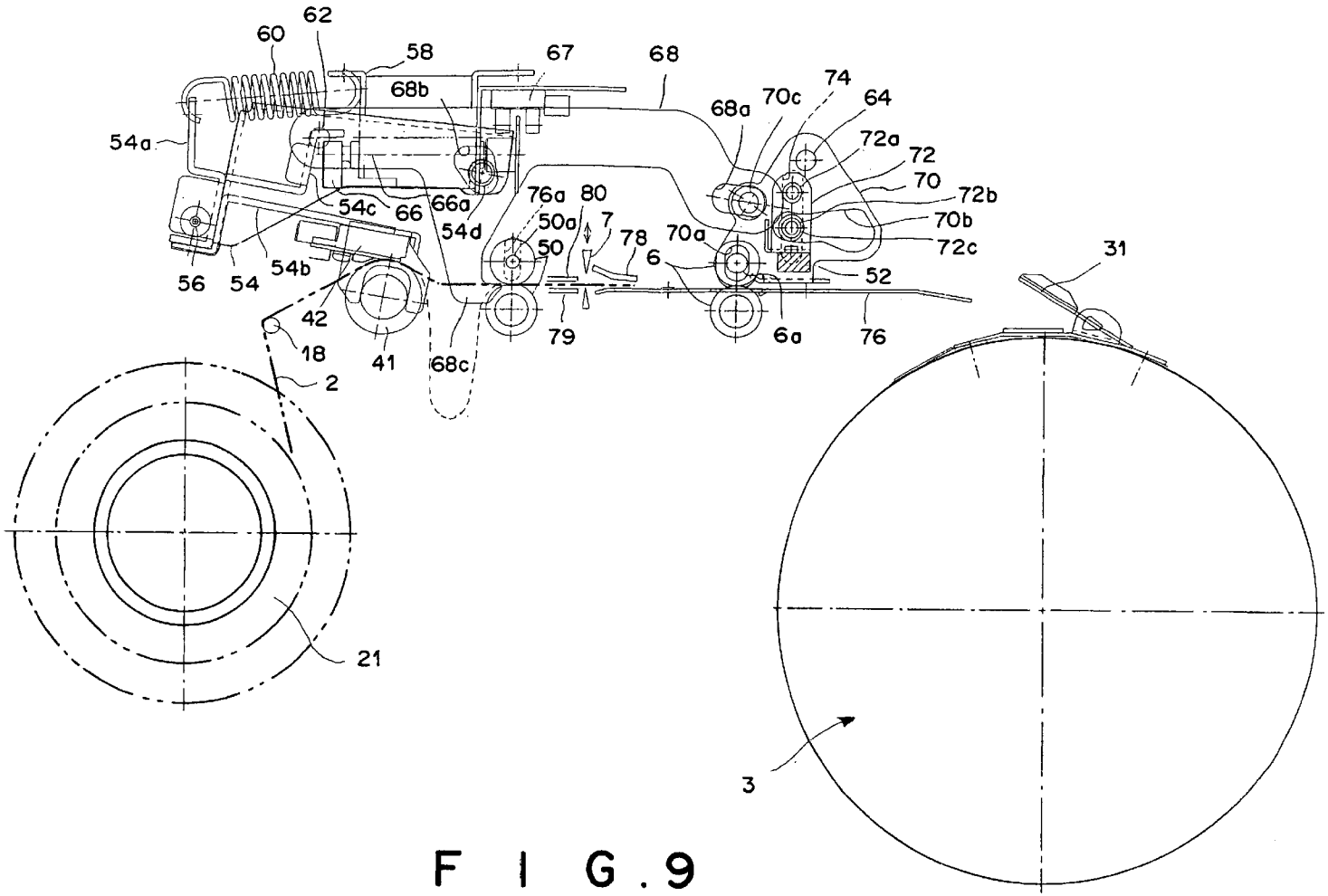
FIG. 9 is a side view showing a stencil printer constructed in accordance a second embodiment of the present invention.
Figure 10:
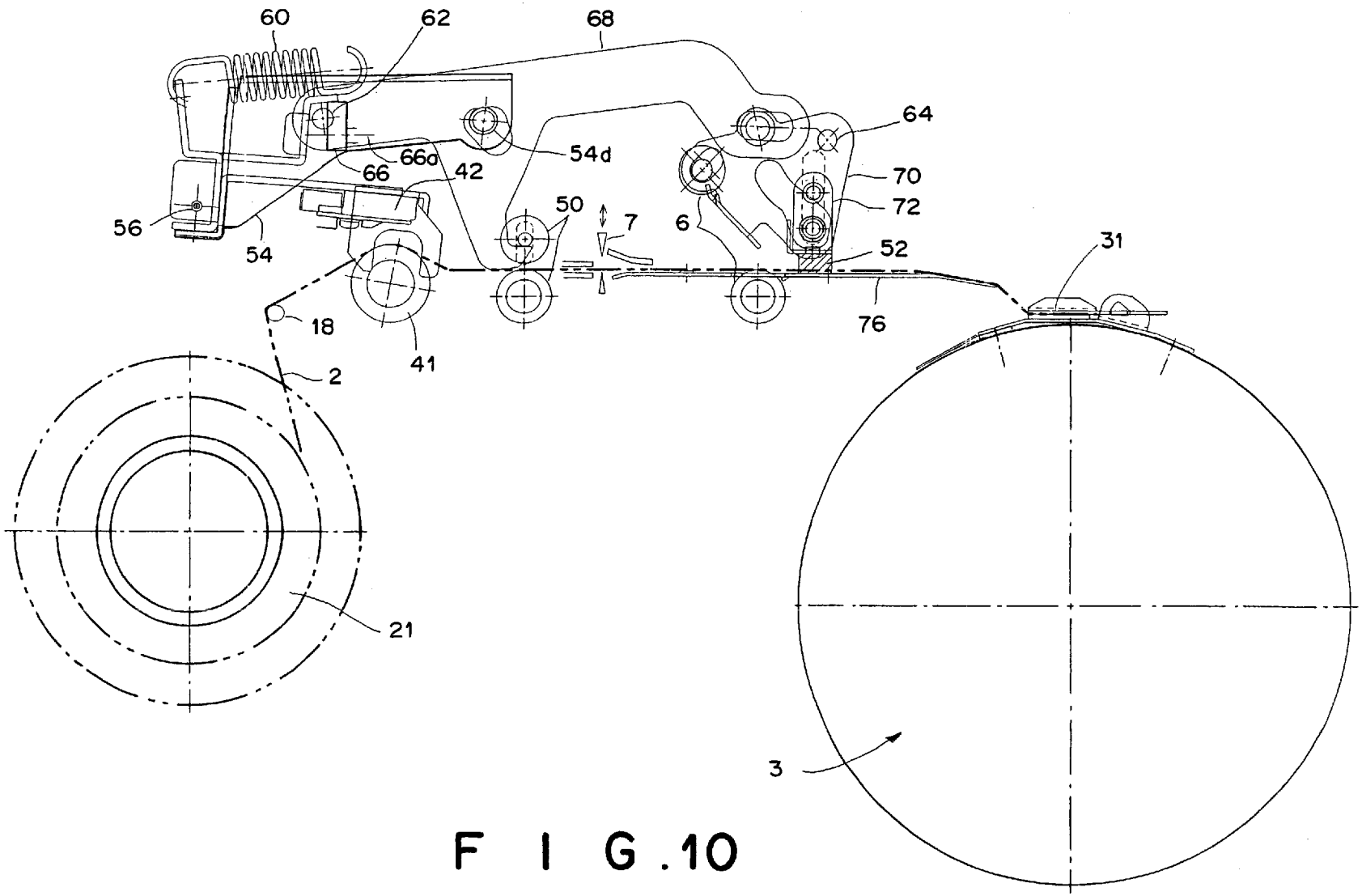
FIG. 10 is a view similar to FIG. 9 showing the state in which the leading end of the perforated master sheet has been clamped by the clamp portion of the master pinch drum.

In the embodiment shown in FIGS. 9 and 10, the same reference numerals will be applied to the same parts as the embodiment shown in FIGS. 1 through 8 and therefore a description thereof will not be given, to avoid redundancy. The embodiment shown in FIGS. 9 and 10 differs from the embodiment shown in FIGS. 1 through 8, in that (1) second discharging rollers 50 are provided instead of the conveying rollers 5, (2) a slack part of a master sheet, which occurs before the master sheet is wrapped around the master pinch drum, is formed between a platen roller and the second discharging rollers 50, (3) a cutter 7 is interposed between discharging rollers 6 and the second discharging rollers 50, (4) a sponge member 52 is provided in place of the tension blade, and so on.

In FIGS. 9 and 10, reference numeral 58 denotes a plate metal member fixedly supported by a pressure plate (not shown) of the stencil printer. One end of a tension spring 60 is anchored to the plate metal member 58. Here, the pressure plate of the stencil printer refers to a generally box-shaped unit (not shown) provided rotatably with respect to a predetermined axis perpendicular to the right and left side plates (not shown) of the stencil printer, with respect to the side plates. The pressure plate is constructed so that it holds the thermal head, etc. The pressure plate is primarily rotated at the initial setting time of the master sheet, and during master making and printing, it is locked to the side plates of the stencil printer. Reference numeral 62 denotes a blade-link shaft fixedly supported by the pressure plate, and reference numeral 64 denotes a guide-plate shaft fixedly supported by the pressure plate. Reference numeral 66 denotes a disc cam, which is supported by the pressure plate so that it is free to rotate on an axis 66*a*. Reference numeral 67 denotes a sensor for detecting the position of rotation (number of rotations) of the cam 66.

Reference numeral 54 denotes a blade arm, which is supported so that it can be rotated on a rear blade-arm shaft 56 fixedly supported by the pressure plate of the stencil printer. A plate metal member 54*a* is mounted on the blade arm 54, and the other end of the aforementioned spring 60 is anchored to the plate metal member 54*a*. Thus, the entire blade arm 54 is urged about the rear blade-arm shaft 56 in the clockwise direction shown in FIG. 9. Also, a plate metal member 54*b* with a thermal head 42 attached thereto is fixed to the blade arm 54. Furthermore, a plate metal member 54*c* is fixed to the blade arm 54, and the peripheral surface of the aforementioned cam 66 abuts the plate metal member 54*c*. A front blade-arm shaft 54*d* is fixedly supported near the front end portion of the blade arm 54.

Reference numeral 68 denotes a blade link, which is supported so that it is rotatable on the aforementioned blade-link shaft 62. The blade link 68 has front and rear blade-link holes 68*a*, 68*b* at the front and central portions, respectively. The blade link 68 also has a claw portion 68*c*.

The aforementioned front blade-arm shaft 54*d* is inserted into the rear blade-link hole 68*b*.

Reference numeral 70 denotes a movable guide plate, which is supported so that it is free to rotate on the aforementioned guide-plate shaft 64. The guide plate 70 has front and rear guide-plate holes 70*b* and 70*a*. The front guide-plate hole 70*b* varies in width, as shown in FIG. 9. The shaft 6*a* of the upper roller of the discharging rollers 6 is inserted into the rear guide-plate hole 70*a*, and the upper roller is urged downward by its dead weight. A guide shaft 70*c* is fixedly attached to the circumferential edge portion of the movable guide plate 70 and inserted into the front blade-link hole 68*a* of the blade link 68.

Reference numeral 72 denotes a mounting plate, which has a lower end on which a sponge member 52 is mounted. The mounting plate 72 has an upper shaft portion 72*a* and a lower shaft portion 72*b* which are perpendicular to the paper surface of FIG. 9. A bearing 72*c* is supported on one end of the lower shaft portion 72*b* and inserted into the front guide-plate hole 70*b* of the movable guide plate 70. On the other hand, the pressure plate of the stencil printer has an elongated hole 74 into which the two shaft portions 72*a* and 72*b* of the mounting plate 72 are inserted. The movement of the mounting plate 72 is regulated by the direction of the elongated hole 74. Since the mounting plate 72 is urged downward by dead weight, the urging force can be adjusted by adjusting this weight.

The side plate of the stencil printer has an elongated hole 76*a* into which the shaft 50*a* of the upper roller of the second discharging rollers 50 is inserted. The upper roller of the second discharging rollers 50 is urged downward by dead weight, while the lower roller serves as a driving roller.

Reference numeral 76 denotes a plate metal member that forms a master conveying path. The sponge member 52 abuts the upper surface of the plate metal member 76 through the master sheet 2. Reference numerals 78, 79, 80 denote plate metal members which also form the master conveying path.

In the construction shown in FIGS. 9 and 10, the blade arms 54, the blade links 68, the movable guide plates 70, and the springs 60 are provided on both sides of the master sheet 2 in the direction perpendicular to the paper surface, respectively. The mounting plates 72 are also provided on both sides of the master sheet 2 and interconnected by the shaft portions 72*a* and 72*b*. The sponge member 52 is mounted across the mounting plates 72 provided on both sides of the master sheet 2. These members are disposed so that they do not disturb the function of each member to be described later. For example, the blade-link shaft 62, the plate metal member 54*c*, and the cam 66 do not interfere with one another.

Now, a description will be given of the master making and master wrapping operations of the stencil printer shown in FIGS. 9 and 10. Since the overall operation is the same as the embodiment shown in FIGS. 1 through 8, the differing point will be described primarily.

During master making, the cam 66 is in the state of FIG. 9 in which the plate metal member 54*c* is not pushed up. Also, the blade arm 54 is most rotated on the rear blade-arm shaft 56 in the clockwise direction by the spring 60 and therefore the thermal head 42 is pressed against the platen roller 41 through the master sheet 2. When this occurs, the blade link 68 is at the position most rotated on the blade-link shaft 62 in the clockwise direction, because the rear blade-link hole 68*b* is not regulated by the front blade-arm shaft 54*d*. Also, the blade-link claw portion 68*c* is out of contact with the shaft 50*a* of the upper roller of the second discharging rollers 50. Also, the front blade-link hole 68*a* does not regulate the guide shaft 70*c* of the movable guide plate 70, so the guide plate 70 is at the position most rotated on the guide-plate shaft 64 in the counterclockwise direction. The rear guide-plate hole 70*a* does not regulate the shaft 6*a* of the upper roller of the discharging rollers 6 upward, so the upper roller rests on the lower roller by dead weight. Furthermore, the bearing 72*c* of the mounting plate 72 is regulated upward by the front guide-plate hole 70*b*, so the sponge member 52 mounted on the mounting plate 72 is at a position spaced upward from the plate metal member 76.

The slack part of the perforated master sheet 2 is stored between the platen roller 41 and the second discharging rollers 50, as shown by a broken line in FIG. 9. The amount of the stored slack part may be the length of a master sheet that is used for single printing. Also, as previously stated, the master sheet may be stored intermittently.

Next, the discharging rollers 6 and the second discharging rollers 50 are rotated so that the leading end of the master sheet 2 is fed to the clamp plate 31 of the master pinch drum 3. In this way, the leading end of the master sheet 2 is conveyed to the clamp plate 31.

When wrapping the master sheet 2 around the master pinch drum 3, the cam 66 is rotated on the axis 66*a* to rotate the blade arm 42 on the rear blade-arm shaft 56 in the counterclockwise direction. This causes the thermal head 54 to rotate on the rear blade-arm shaft 56 in the counterclockwise direction through the plate metal member 54*c*, so that the thermal head 54 is spaced from the platen roller 41. In addition, the front blade-arm shaft 54*d* causes the blade link 68 to rotate on the blade-link shaft 62 in the counterclockwise direction through the rear blade-link hole 68*b*. The blade-link claw portion 68*c* pushes the shaft 50*a* of the upper roller of the second discharging rollers 50 upward, thereby pushing the upper roller of the second discharging rollers 50 upward. At the same time, the guide shaft 70*c* of the movable guide plate 70 is pushed upward by the front blade-link hole 68*a* of the blade link 68. The movable guide plate 70 is 25 rotated on the guide-plate shaft 64 in the clockwise direction. The upper roller of the discharging rollers 6 is also spaced from the lower roller. At this stage, the regulation of the bearing 72*c* of the mounting plate 72 by the front guide-plate hole 70*b* is released and therefore the mounting plate 72 is lowered by dead weight. The sponge member 52 mounted on the mounting plate 72 is pressed against the upper surface of the plate metal member 76 through the master sheet 2. Thus, when the master sheet 2 with the leading end clamped by the clamp portion 31 of the drum 3 is wrapped around the master pinch drum 3, the master sheet 2 is given stable back tension by the sliding resistance generated by the sponge member 53, so that an accurate master-wrapping operation is performed. Note that in the process of wrapping the master sheet 2 around the master pinch drum 3, the rolling resistance generated by the master roll 21 (which is determined by a member for supporting the master roll 21), in addition to the sliding resistance generated by the sponge member 53, is exerted on the master sheet 2 for a short time before cutting, depending on the timing at which the master sheet 2 is cut by the cutter 7. However, the rolling resistance generated by the master roll 21 has little influence on master-wrapping precision.

In the stencil printer shown in FIGS. 9 and 10, the same effect as the-stencil printer shown in FIGS. 1 through 8 is obtained.

While the present invention has been described with reference to the preferred embodiments thereof, the invention is not to be limited to the details given herein, but may be modified within the scope of the appended claims.

In addition, all of the contents of the Japanese Patent Application No. 11(1999)-195486 are incorporated into this specification by reference.

What is claimed is:

1. A stencil printer, in which, after a master sheet perforated at a master making section is slackened in a conveying path to a master pinch drum, the master sheet is clamped at its leading end by a clamp portion and wrapped around the master pinch drum and printing is performed, said stencil printer comprising:

an elastic member provided on a master conveying path between a roll of un-perforated master sheet and the master pinch drum, the elastic member including a blade having a blade position substantially transverse to a conveying direction of the master sheet, said blade being non-rotateably pressed against the perforated master sheet to apply back tension to the perforated master sheet when the perforated master sheet is moved by rotation of the master pinch drum after the leading end of the perforated master sheet has been clamped to the clamp portion of the master pinch drum.

2. A stencil printer, in which, after a master sheet perforated at a master making section is slackened in a conveying path to a master pinch drum, the master sheet is clamped at its leading end by a clamp portion and wrapped around the master pinch drum and printing is performed, wherein along a master conveying path from a roll of unperforated master sheet to the master pinch drum, the master making section master conveying rollers and master discharging rollers are disposed in order so that the peforated master sheet is slackened between the master conveying rollers and the master discharging rollers; and an elastic member provided between the master discharging rollers and the master pinch drum, the elastic member including a blade having a blade position substantially transverse to a conveying direction of the master sheet, said blade being non-rotateably pressed against the perforated master sheet to apply back tension to the perforated master sheet when the perforated master sheet is moved by rotation of the master pinch drum after the leading end of the perforated master sheet has been clamped to the clamp portion of the master pinch drum.

3. The stencil printer as defined in claim 2 in which the master discharging rollers apply no load to the perforated master sheet being moved, when the elastic member is in pressing contact with the perforated master sheet.

4. A stencil printer, in which, after a master sheet perforated at a master making section is slackened in a conveying path to a master pinch drum, the master sheet is clamped at its leading end by a clamp portion and wrapped around the master pinch drum and printing is performed, wherein along a master conveying pat from a roll of unperforated master sheet to the master pinch drum, the master making section master conveying rollers, and master discharging rollers are disposed in order so that the peforated master sheet is lickened between the master conveying rollers and the master discharging rollers; and an elastic member and a smoothing member provided between the master discharging rollers and the master pinch drum, the smoothing member being fixed with the stencil printer, the elastic member including a blade having a blade position substantially transverse to a conveying direction of the master sheet, said blade being non-rotteably pressed against the perforated master sheet to apply back tension to the perforated master sheet when the perforated master sheet is moved by rotation of the master pinch drum after the leading end of the perforated master sheet has been clamped to the clamp portion of the master pinch drum.

5. The stencil printer as defined in claim 4 in which the master discharging rollers apply no load to the perforated master sheet being moved, when the elastic member is in pressing contact with the perforated master sheet.

* * * * *